United States Patent [19]

Hentschel

[11] Patent Number: 4,640,646

[45] Date of Patent: Feb. 3, 1987

[54] APPARATUS FOR THE CONSTRUCTION OF TUNNELS AND SHAFTS

[75] Inventor: Volker Hentschel, Dorsten-Wulfen, Fed. Rep. of Germany

[73] Assignee: Hochtief Aktiengesellschaft vorm Gebr Helfmann, Essen, Fed. Rep. of Germany

[21] Appl. No.: 690,163

[22] Filed: Jan. 10, 1985

[30] Foreign Application Priority Data

Jan. 13, 1984 [DE] Fed. Rep. of Germany ..... 3401012

[51] Int. Cl.[4] ..... E21D 9/06; E21D 9/08

[52] U.S. Cl. ..... 405/141; 405/146; 299/33

[58] Field of Search ..... 299/31, 33, 55; 405/138, 141, 142, 143, 146

[56] References Cited

U.S. PATENT DOCUMENTS 3,967,463 7/1976 Grandori ..... 299/33 X 4,432,665 2/1984 Stuckmann et al. ..... 299/31 X 4,548,443 10/1985 Turner ..... 299/31

FOREIGN PATENT DOCUMENTS 453414 6/1968 Switzerland .

*Primary Examiner*—Stephen J. Novosad

*Assistant Examiner*—Michael A. Goodwin

*Attorney, Agent, or Firm*—Karl F. Ross; Herbert Dubno

[57] ABSTRACT

A tunneling machine with a leading ring, a follower ring, an overlapping joint connection between the leading ring and the follower ring, a pressure ring, advancing piston/cylinder assemblies, and a roll correction device. The advancing piston/cylinder assemblies are distributed about the shield circumference, and they are connected on the one hand by the way of linkages to the pressure ring, and on the other hand they are supported at the leading or shield ring. The roll correction device has a roll correction ring which is arranged in the leading ring, and the roll correction ring can rotate with respect to the leading shield. The roll correction ring is also supported by a thrust-absorbing bearing. The advancing piston/cylinder assemblies are movably joined at the roll correction ring, and are indirectly supported at the leading ring. The adjusting piston/cylinder assemblies are primarily disposed in the direction of a line which is similar to a secant, and between the roll correction ring and the thrust-absorbing bearing.

8 Claims, 3 Drawing Figures

APPARATUS FOR THE CONSTRUCTION OF TUNNELS AND SHAFTS

CROSS REFERENCE TO RELATED APPLICATION

The application is related to my copending application Ser. No. 674,895 filed Nov. 26, 1984.

FIELD OF THE INVENTION

My present invention relates to a tunneling and gallery excavating apparatus or machine and, more particularly, to a machine for the construction of subterranean tunnels, shafts or galleries.

BACKGROUND OF THE INVENTION

As noted in the earlier application, an apparatus for the construction of tunnels and shafts and, more particularly, a mine gallery excavator can have a leading ring or shield, and a follower or trailing ring or shield, wherein the two rings or shields can be united to form a unitary shield structure by a joint connection. The leading shield can carry the excavator head which is advanced with the leading shield by hydraulic jacks or piston and cylinder arrangements braced by the machine rearwardly thereof. After a certain degree of advance of the tunnel or gallery, these jacks draw the trailing shield forwardly and casing sections can be introduced behind the trailing shield and concrete pumped into the clearance defined between the casing and the excavated tunnel wall.

The apparatus also can include therefore at least one pressure ring, a plurality of advancing piston/cylinder assemblies, and a roll correction device. The advancing piston/cylinder assemblies are distributed about the shield circumference, and they are connected by way of linkages to the pressure ring.

The advancing piston/cylinder assemblies are also supported by way of linkages at the leading shield. The roll correction device has adjusting piston/cylinder assemblies by means of which the inclination of the advancing piston/cylinder assemblies can be adjusted with respect to the longitudinal axis of the generatrices of the shield.

I have found that under conditions of nonhomogeneous soil, ground or rock, hereinafter generally referred to as surrounding formation, as well as in the case of structural changes of the apparatus, there is little one can do to prevent torque reactions at the body of the shield.

Furthermore, torque reactions can not be avoided at the shield, at least when drilling into rock and other ground in full-cut fashion with rotating tools, and rotary motions are experienced about the longitudinal axis of the shield. Such movements are referred to as roll, rolling or revolving out-of-true, and include similar twisting or gyrating motions, and misalignments.

Such undesired movements affect the leading shield and the follower or trailing shield, individually and jointly. These undesirable movements are particularly critical when using a follower ring which is linked to a respective component by a movable connection which is formed by piston/cylinder arrangements, because such piston/cylinder assemblies allow only limited relative roll movements.

In apparatus which has found practical application, heretofore, the roll correction device cooperates with the pressure ring. Auxiliary means provided by adjusting piston/cylinder assemblies, which are correspondingly supported or braced, serve to rotate the pressure ring about its axis with respect to the precursor ring. This rotation causes the inclination of the advancing piston/cylinder assemblies which are directly mounted at the precursor shield, and torque is created at a cost of only a slightly reduced longitudinal advancing force, when the advancing force is applied which produces the respective inclined component. In this way, the torque which would cause a twisting or gyrating motion can be generally compensated. As well, a leading shield which does not operate as desired can be controlled.

The described rotation of the pressure ring is not easily achieved and requires a certain disturbance of the respective adjoining region. During operation of the advancing piston/cylinder assemblies, the pressure ring according to one prior art embodiment must be adjustable for roll correction.

Separate rotation of the pressure ring is not feasible when the pressure ring is connected to the follower shield so as to rotate therewith. Such connection is customarily employed and is preferred.

A simple correction of the relative roll or offset motion between the precursor shield and the follower shield cannot be achieved actively in prior art equipment.

OBJECTS OF THE INVENTION

It is therefore the principal object of the invention to provide an improved tunneling or shaft drilling apparatus which substantially precludes the disadvantages of the prior art.

It is also an object of my invention to provide an improved drilling apparatus of the type briefly described which allows roll correction without undue rotation of the pressure ring.

It is furthermore an object of the invention to provide a propulsion system for an apparatus of the type described in the foregoing which allows active adjustment between the leading shield and the follower shield.

It is also an object of the present invention to provide an improved apparatus which can be operated in an uncomplicated manner.

It is further an object of my invention to provide an apparatus wherein the rotation of the roll correction ring can be done with ease.

SUMMARY OF THE INVENTION

These objects are attained in accordance with the invention in that the roll correction device is provided by a roll correction ring which is arranged in the leading shield and which can rotate with respect to the leading shield. Furthermore, the roll correction ring can cooperate with a thrust-absorbing bearing member, for example a support ring.

The respective advancing piston/cylinder assemblies are movably joined at the roll correction ring so as to be indirectly connected to the precursor ring.

Respective adjusting piston/cylinder assemblies are primarily disposed in a line equivalent to that of a secant and between the roll correction ring and the support ring.

In accordance with a preferred embodiment, the thrustabsorbing bearing for the roll correction ring is a support ring, and this support ring is equipped with connection joints, brackets, or pads, for the adjusting piston/cylinder assemblies. It is also preferred that the support ring is secured in the precursor shield.

According to another preferred embodiment, the adjusting piston/cylinder assemblies include double-acting piston members, so as to perform, as it were, a correction of positive and negative unit-magnitude.

The invention is based on the understanding that roll correction does not require more than the regular functioning of the pressure ring. Also, the roll correction ring can be arranged and connected in the precursor shield or ring.

It is preferred that the roll correction ring not be directly in active contact with the surrounding formation, and that the roll correction ring be inwardly offset. Furthermore, the roll correction ring is cooperating with the thrust-absorbing bearing member, for example a support ring, in such a way that friction would generally not become a problem, and rotation of the roll correction ring can be done with ease.

The apparatus, accordingly, allows carrying out of roll corrections without difficulties when the advancing piston/cylinder assemblies are actuated or operative for propulsion of the apparatus.

I prefer to provide a movable connection between the precursor shield and the follower shield. This connection includes connecting piston/cylinder assemblies distributed about the shield circumference. The piston/-cylinder assemblies are supported and/or attached, by way of joints arranged at both ends thereof, at the precursor shield and the follower shield, respectively. This embodiment allows active correction effects between the precursor ring and the follower ring.

According to a feature of the invention, the respective adjusting piston/cylinder assemblies are connected to the roll correction ring, and the roll correction ring is arranged for this in the region of the overlapping joint between the precursor ring and the follower ring.

Advantageously a second roll correction ring, with thrust-absorbing bearing member and adjusting piston/-cylinder assemblies, is provided, and the connecting piston/cylinder assemblies are connected to this second roll correction ring which, for this purpose, is arranged in the region of the overlapping joint.

BRIEF DESCRIPTION OF THE DRAWING

The above and other objects, features and advantages will become apparent from the following description, reference being made to the accompanying drawing, in which.

SPECIFIC DESCRIPTION

Figure 1:
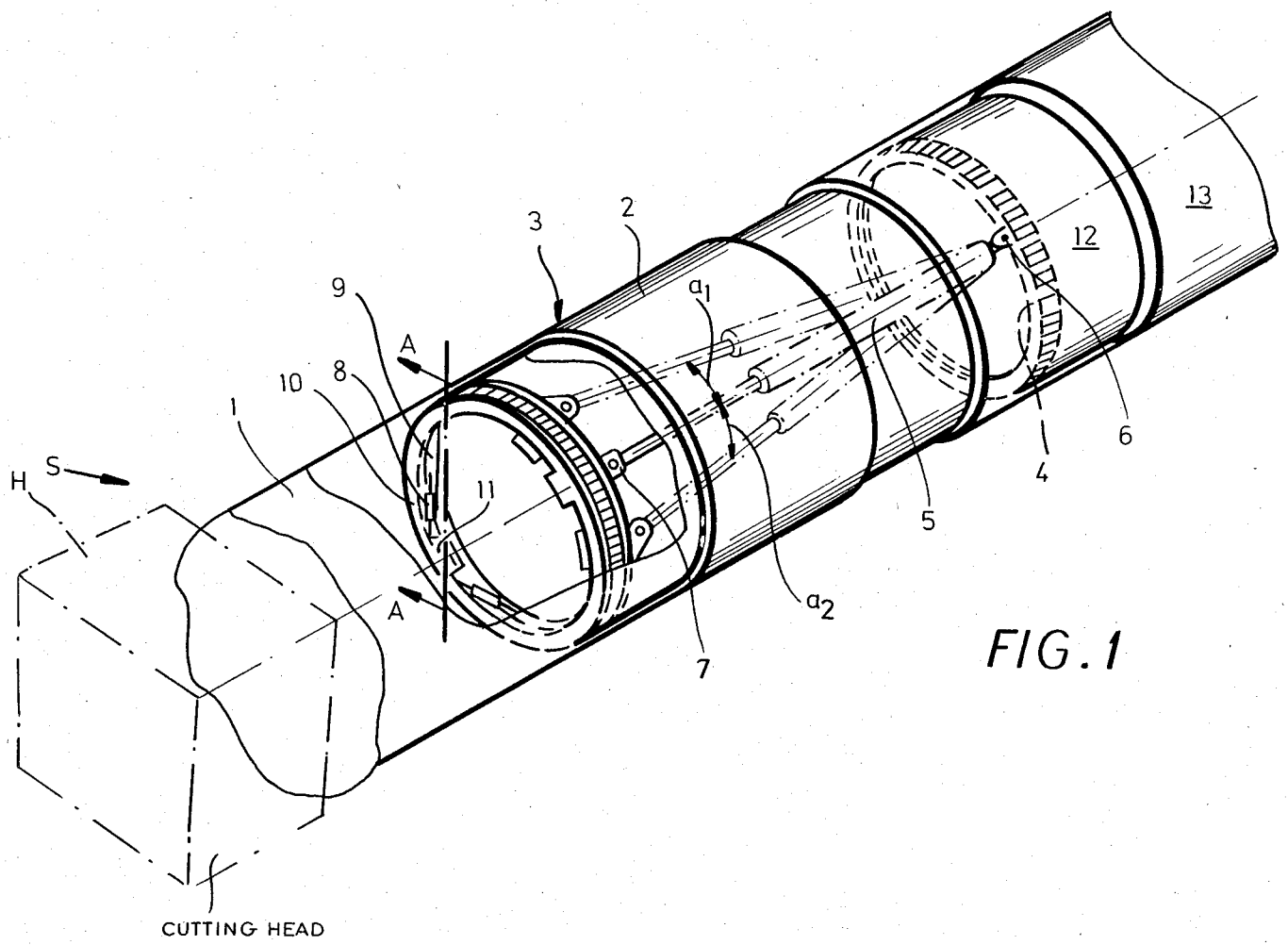
FIG. 1 is a schematic perspective view of one embodiment of the invention.

The apparatus shown in the drawing is intended for the digging of tunnels, the drilling of shafts, and similar excavating, mining, and the like operations or propulsions into and through rock, earth and similar formations.

Figure 2:
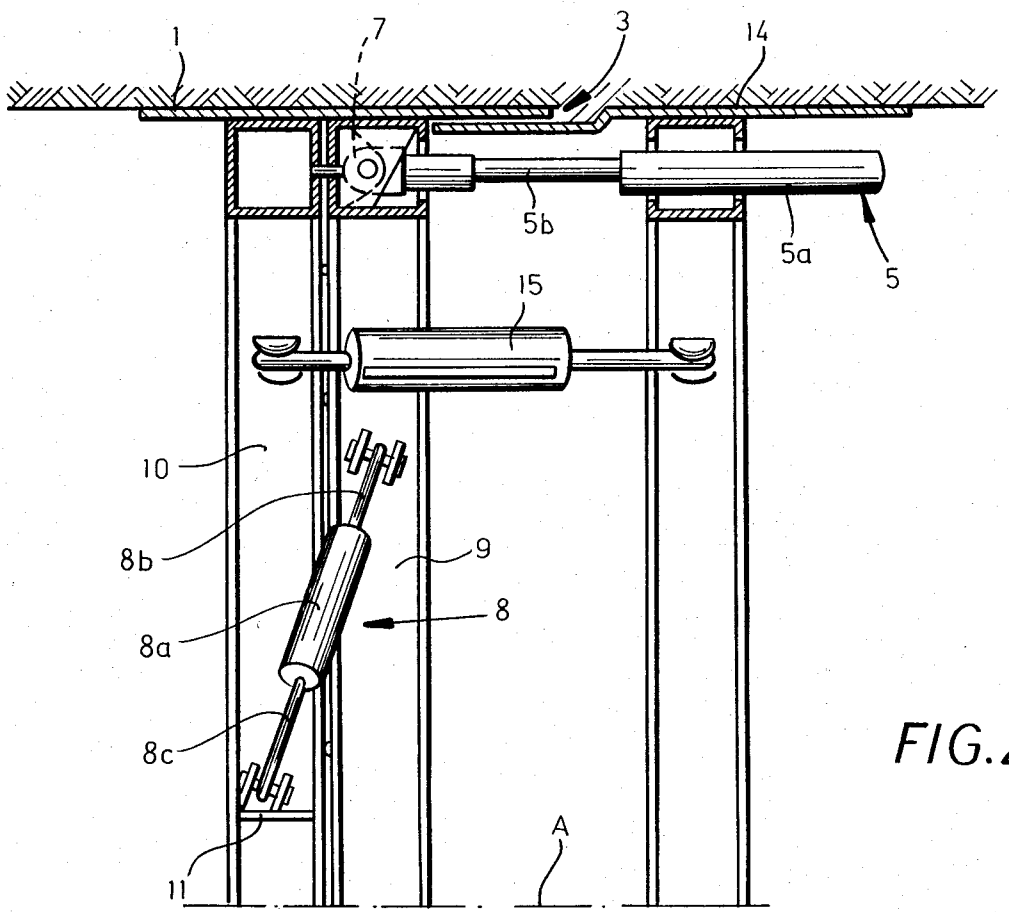
FIG. 2 is a cross section, drawn to a larger scale, along line A—A in FIG. 1.

The basic configuration of the apparatus includes a shield structure "S", carrying the excavating head H and generally comprising a leading ring, tubbing, or shield 1 and a follower ring, tubbing, or shield 2 (FIG. 2). The two rings or shields are connected by an overlapping joint connection 3. The apparatus further includes a pressure ring 4, and a plurality of advancing piston/cylinder assemblies 5, of which only one has been shown in FIG. 1. This apparatus is described in the aforementioned application together with its operation (see also U.S. Pat. No. 4,436,448). The apparatus also includes a roll correction device which will be further described in the following description.

The advancing double-acting piston/cylinder assemblies 5 are distributed about the circumference of the shield. As shown in FIG. 1, the cylinder **5*a* is attached to the pressure ring 4 by way of means allowing movable joining, such as a bracket or clevis 6 and similar linkages. The respective piston 5*b* is connected to a clevis 7, or like means allowing movable joining, or a similar linkage, which is interiorly mounted on the wall of the precursor ring 1**, i.e. in an indirect manner, as will be described in greater detail below.

As is schematically indicated in FIG. 1, the piston/-cylinder assembly 5 can be inclined with respect to the longitudinal axis "A" of the shield "S" and/or with respect to the circumferential walls, or mantle lines, of the precursor ring 1 and the follower ring 2. The inclination is primarily achieved by adjusting double-acting piston/cylinder assemblies 8 forming part of the roll correction device.

The roll correction device includes a roll correction ring 9 arranged in the precursor ring 1. The roll correction ring 9 can be rotated with respect to the precursor ring 1 and cooperates with a support ring 10 which is adapted to act as a thrust-absorbing bearing or similar element or member for the roll correction ring 9.

The support ring 10 is furnished with means allowing movable joining, for example clevises 11, or similar brackets and pads, or linkages, and each piston/cylinder assembly 8 can be secured at the support ring 10 by way of such clevis 11.

The advancing piston/cylinder assemblies 5 are forwardly attached to the roll correcting ring 9 and are indireclty connected in this manner to the leading shield 1, as mentioned before.

The adjusting piston/cylinder assemblies 8 are arranged between and respectively connected to the support ring 10 and the roll correction ring 9. The piston/-cylinder assemblies 8 extend generally in a line equivalent to a secant with respect to the main axis "A" of the apparatus or shield. The piston/cylinder assembly 8 includes double-acting pistons, i.e. the respective cylinder **8*a* is equipped with a reciprocating piston or piston end 8*b* for connecting it to the roll correction ring 9. The cylinder 8*a* also includes a piston or piston end 8*c* which is connected to the mentioned clevis 11 of the support ring 10**.

The roll correction ring 9 of the apparatus is, accordingly, capable of executing rotations in both directions with respect to the leading shield 1 and the follower shield 2. Such rotations would be primarily effected by the adjusting piston/cylinder assemblies 8.

FIG. 2 illustrates in greater detail that the roll correction ring 9, as it were, is positioned in inset or recessed manner in the leading shield 1 and ahead of the follower shield 2. Accordingly, the roll correction ring 9 does not make contact with the surrounding formation into which, or through which, the apparatus is working. This surrounding formation may be soil, rock or other ground and the reference numeral 14 is assigned for this in FIG. 1.

The operation of the apparatus will be explained next. When the roll correction is to be carried out, for example to correct a misalignment wherein the longitudinal axis of the advancing piston/cylinder assembly 5 is inclined or deviated from the normal position, as schematically indicated by the angle $a_1$ in FIG. 1. The angle $a_1$ is indicating a positive deviation or a positive inclination from the respective base line. By way of rotation of the roll correction ring 9, the advancing piston/cylinder assembly 5 carries out a movement equivalent to the negative inclination represented by the angle $a_2$. During the forward or advancing movement, tangentially directed supporting forces are effective which counter the roll or misalignment of the leading shield 1.

The forces are dissipated or transferred in the rearward direction via the pressure ring 4 to the casing 12. Further transfer of forces is achieved by mantle friction into the hardening concrete casing 13 and from there into the surrounding formation 14 (FIG. 2).

The articular or movable connection which links the leading shield 1 and the follower ring 2 is schematically indicated in FIG. 2 to include a connecting piston/cylinder assembly 15. FIG. 1 clearly indicates that the roll correction ring 9 can be moved very closely to the overlapping joint connection 3. Accordingly, the connecting piston/cylinder assembly 15 can cooperate, as described, with the roll correction ring 9. Alternately, it is feasible to provide a further roll correcting ring 9''. The assemblies 15 merely prevent uncontrolled separation of the members 1 and 2 while permitting the one to be articulated to the other.

Figure 3:
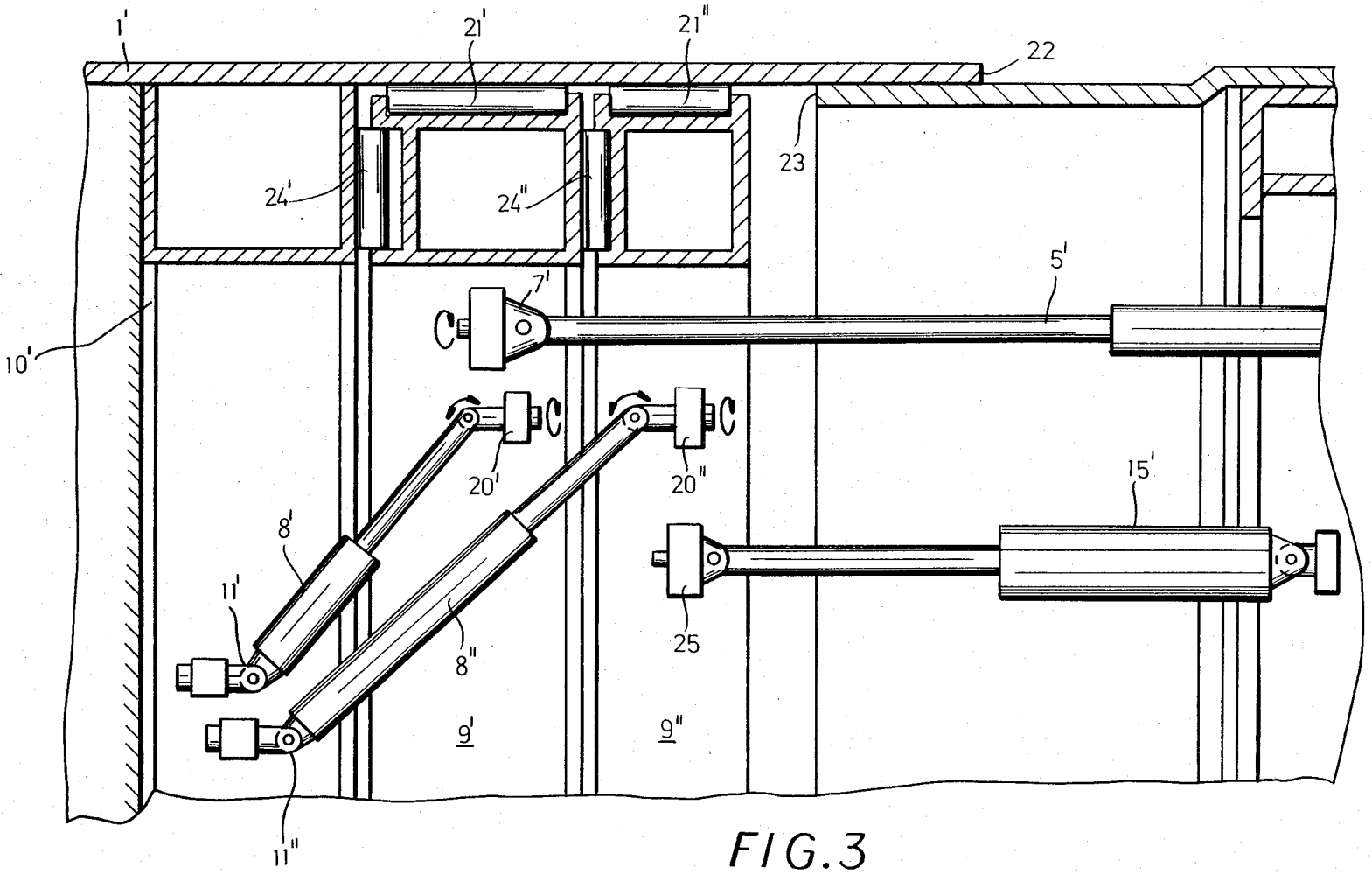
FIG. 3 is a schematic sectional view showing an embodiment having a second roll correction ring.

As can be seen in FIG. 3, for example, the pressure ring 10' is welded to the leading shield 1' and has swivel connections 11' and 11'' for the double acting cylinder arrangements or jacks 8', 8'' extending generally secantially and pivotally connected at their opposite ends to the two roll-correction rings 9' and 9'' via swivels 20', 20''.

Each roll correction ring 9', 9'' is provided with a set a radially effective roller bearings 21', 21'' riding along the interior of the leading shield 1' and inset from the end 22 thereof which overlaps the end 23 of the trailing shield so that the two shields telescopingly interfit. Each roll correction ring 9', 9'' also carries axially effective roller bearings 24', 24'' braced respectively against the thrust or pressure ring 10' and against the ring 9'. The advancing cylinder units 5' are connected by swivels 7' to the ring 9' and the double-acting coupling cylinder units 15' are connected by swivels 25 to the correction ring 9''.

I claim:

1. A tunneling apparatus comprising:

a shield structure including a leading shield, a follower shield, and a joint connection for joining said leading shield and said follower shield;

a pressure ring mounted in said follower shield and at least one means for receiving thrust forces mounted in said leading shield;

a roll correction device mounted in said shield structure and including a roll correction ring in said leading shield and which can rotate with respect to the leading shield and bearing upon said means for receiving thrust forces;

a plurality of advancing piston/cylinder assemblies, distributed about the shield circumference and movably connected to said pressure ring and to said roll correction ring but acting upon said leading shield only through said roll correction ring; and a plurality of adjusting piston/cylinder assemblies mounted at said roll correction device, said adjusting piston/cylinder assemblies being oriented generally secantially and being braced between said means for receiving thrust forces and said roll correction ring for controlling the orientations of said advancing piston/cylinder assemblies with respect to said leading shield and said follower shield.

2: The apparatus according to claim 1 wherein said joint connection is an overlapping joint connection formed by a portion of said leading shield and a portion of said follower shield.

3. The apparatus according to claim 1 wherein said means for receiving thrust forces is a support ring which is secured in said leading shield and which cooperates with said roll correction ring.

4. The apparatus according to claim 3 wherein said support ring is provided forwardly with respect to said roll correction ring.

5. The apparatus according to claim 1 wherein each of said assemblies is connected to the respective rings by at least one clevis.

6. The apparatus according to claim 1 wherein said adjusting piston/cylinder assemblies are double-acting piston/cylinder assemblies.

7. The apparatus according to claim 1, further comprising:

a plurality of connecting piston/cylinder assemblies which are distributed about the shield circumference, and are connected with respective movable joints on the one hand at said follower shield, and are supported at said leading shield, said plurality of connecting piston/cylinder assemblies including at least one assembly which is connected to said roll correction ring.

8. The apparatus according to claim 1, further comprising:

a plurality of connecting piston/cylinder assemblies which are distributed about the shield circumference, and are connected by respective movable joints on the one hand at said follower shield, and are supported at said leading shield;

a second roll correction ring cooperating with said means for receiving thrust forces; and a plurality of adjusting piston/cylinder assemblies for said second roll correction ring, said plurality of connecting piston/cylinder assemblies including at least one assembly which is connected to said second roll correction ring.

* * * * *